US007726229B2

(12) United States Patent
Schwerman et al.

(10) Patent No.: US 7,726,229 B2
(45) Date of Patent: Jun. 1, 2010

(54) ROTATABLE AND RETRACTABLE REAR GUN SIGHT

(75) Inventors: Gregory D Schwerman, New Berlin, WI (US); Ronald W Albanese, Watertown, WI (US)

(73) Assignee: Crane Tactical LLC, Waukesha, WI (US)

( * ) Notice: Subject to any disclaimer, the term of this patent is extended or adjusted under 35 U.S.C. 154(b) by 372 days.

(21) Appl. No.: 11/807,722

(22) Filed: May 30, 2007

(65) Prior Publication Data

US 2009/0188147 A1 Jul. 30, 2009

Related U.S. Application Data

(60) Provisional application No. 60/854,327, filed on Oct. 25, 2006.

(51) Int. Cl.
*F41G 1/16* (2006.01)

(52) U.S. Cl. ..... 89/41.17; 42/125; 42/126; 42/128; 42/133; 42/136; 42/138; 42/140; 42/141

(58) Field of Classification Search ..... 42/111, 42/124–126, 128, 133, 136–141, 148; 89/41.17
See application file for complete search history.

(56) References Cited

U.S. PATENT DOCUMENTS

| | | | | | |
|---|---|---|---|---|---|
| 36,760 | A | * | 10/1862 | Allen | 42/140 |
| D34,244 | S | | 3/1901 | Barger | |
| 830,442 | A | * | 9/1906 | King, Jr. | 42/140 |
| 861,652 | A | * | 7/1907 | Hawkins | 42/136 |
| 1,027,892 | A | * | 5/1912 | Peck, Jr. et al. | 42/140 |
| 1,314,472 | A | * | 8/1919 | Harkom | 42/140 |
| 1,433,422 | A | * | 10/1922 | Spencer | 42/140 |
| 1,466,913 | A | * | 9/1923 | Matthews | 42/140 |
| 1,586,413 | A | * | 5/1926 | Doornbos | 42/140 |
| 2,710,453 | A | * | 6/1955 | Beverly | 42/128 |
| 2,904,888 | A | * | 9/1959 | Niesp | 42/141 |
| 3,568,324 | A | * | 3/1971 | Jorczak | 42/142 |
| 3,732,642 | A | * | 5/1973 | Bray | 42/124 |
| 3,834,035 | A | | 9/1974 | Merrill | |
| 3,851,400 | A | | 12/1974 | Michalak | |
| 3,866,516 | A | | 2/1975 | Frisoli | |
| 3,969,827 | A | * | 7/1976 | Ellis | 42/136 |
| 3,984,916 | A | * | 10/1976 | Newcomb et al. | 42/140 |
| 4,006,531 | A | * | 2/1977 | Kwako | 42/141 |
| 4,017,995 | A | * | 4/1977 | Hughes, Jr. | 42/136 |
| 4,127,943 | A | | 12/1978 | Tiritilli | |
| 4,200,989 | A | | 5/1980 | Brouthers | |
| 4,223,446 | A | * | 9/1980 | Villa | 42/141 |

(Continued)

OTHER PUBLICATIONS

Exhibit A: Prior art gun sight.

(Continued)

*Primary Examiner*—Bret Hayes
*Assistant Examiner*—Michael D David
(74) *Attorney, Agent, or Firm*—Quarles & Brady LLP

(57) ABSTRACT

A rotatable and retractable rear gun sight is disclosed. The rear gun sight is coupled to a body of a gun. Three different apertures are provided for rear sight viewing of targets of three different distances. The apertures can be rotated out of view or into use depending on the estimated target distance. The rear gun sight can also be flipped down.

12 Claims, 4 Drawing Sheets

U.S. PATENT DOCUMENTS

| | | | | |
|---|---|---|---|---|
| 4,461,087 | A | 7/1984 | Norman | |
| 4,628,611 | A | 12/1986 | Ruffino | |
| 4,688,345 | A | 8/1987 | Kilgour | |
| 4,790,075 | A | 12/1988 | Howard, Sr. | |
| 4,937,944 | A * | 7/1990 | Montalvo | 42/141 |
| 4,993,158 | A | 2/1991 | Santiago | |
| 5,067,244 | A * | 11/1991 | Montalvo | 42/141 |
| D328,485 | S | 8/1992 | Crowley | |
| 5,408,778 | A | 4/1995 | Goodwin et al. | |
| 5,533,292 | A * | 7/1996 | Swan | 42/123 |
| 5,561,910 | A * | 10/1996 | Maynard | 33/265 |
| 5,577,326 | A | 11/1996 | Montelin | |
| 5,638,604 | A * | 6/1997 | Lorocco | 42/132 |
| D406,303 | S | 3/1999 | Ramsey | |
| 5,920,995 | A | 7/1999 | Sammut | |
| 6,012,376 | A | 1/2000 | Hanke et al. | |
| 6,032,374 | A | 3/2000 | Sammut | |
| D429,789 | S | 8/2000 | Sheehan | |
| 6,176,031 | B1 * | 1/2001 | Ramsey | 42/90 |
| 6,477,778 | B1 * | 11/2002 | Lorocco | 33/265 |
| 6,490,060 | B1 | 12/2002 | Tai et al. | |
| 6,594,937 | B2 * | 7/2003 | Weichert et al. | 42/105 |
| 6,622,415 | B1 * | 9/2003 | Canaday et al. | 42/140 |
| 6,662,486 | B2 | 12/2003 | Komberger | |
| 6,678,987 | B2 * | 1/2004 | Howe | 42/132 |
| 6,681,512 | B2 | 1/2004 | Sammut | |
| 6,732,467 | B1 * | 5/2004 | Luth | 42/138 |
| 6,779,290 | B1 * | 8/2004 | Houtsma | 42/148 |
| 6,968,643 | B2 * | 11/2005 | Woodbury | 42/137 |
| 7,076,907 | B2 | 7/2006 | Nesseth et al. | |
| 7,181,882 | B2 * | 2/2007 | Woodbury | 42/137 |
| D546,916 | S * | 7/2007 | Schwerman et al. | D22/109 |
| 7,356,962 | B2 * | 4/2008 | Swan | 42/147 |
| 7,367,152 | B2 * | 5/2008 | Samson | 42/128 |
| 2004/0025398 | A1 * | 2/2004 | Howe | 42/132 |
| 2009/0038202 | A1 * | 2/2009 | Nemec | 42/137 |
| 2009/0049734 | A1 * | 2/2009 | Storch et al. | 42/136 |
| 2009/0071056 | A1 * | 3/2009 | Storch et al. | 42/137 |

OTHER PUBLICATIONS

Webpage printout of rotary drum sight; www.gunbroker.com/Auction/ViewItem.aspx?Item=161549736; admitted prior art.

* cited by examiner

ROTATABLE AND RETRACTABLE REAR GUN SIGHT

RELATED APPLICATION

This application claims the benefit of Provisional Patent Application Ser. No. 60/854,327 filed 25 Oct. 2006.

BACKGROUND OF THE INVENTION

Guns are often equipped with a front sight and a rear sight to provide a two-point visual reference for locating an intended target.

A user views the target through the rear sight, closest to the user's eye, and then aligns the front sight, typically a pin, on the target.

The rear sight is sometimes equipped as a "peep sight," or a circular structure with a void space in the middle for referencing and framing the front site. With the increasing use and popularity of long-range firearms such as rifles, the use and popularity of scope sights have likewise increased.

SUMMARY OF THE INVENTION

This invention relates to a rotatable and retractable rear gun sight for attachment to a gun. The rear gun sight member is rotatable to expose one of two or more apertures provided on the rotatable rear sight member. The different apertures can be used for different estimated target distances, from nearer to farther. Because the plurality of apertures are spaced further apart from their axis of rotation, a longer distance from the axis of rotation will result in a farther target distance, because aligning the aperture and the front sight will result in raising the tip of the gun barrel.

A retractable frame member is provided, which is rotatable about a second axis of rotation. The frame member retracts from a first, generally vertical shooting position to a second, generally horizontal non-shooting position. This member is coupled to the body of a gun.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
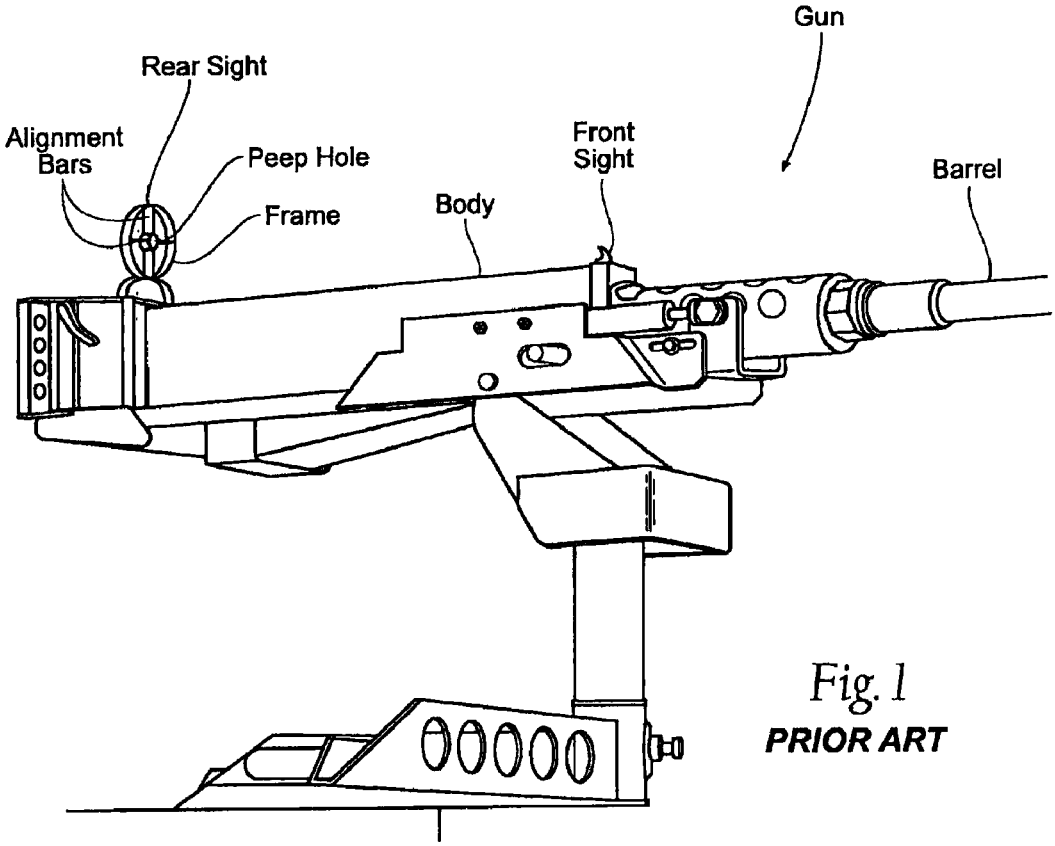
Fig. 1 PRIOR ART
FIG. 1 is a prior art rear sight, attached to a body of a gun, and a front sight.

Referring now to FIG. 1, a prior art rear sight is shown attached to a body of a gun. A front sight is shown to provide a two-point, and considering the target, a three-point frame of reference so that the shooter can align the gun with the intended target. In use, a user looks through the rear sight and locates the front sight on the target. This creates a two-point alignment system, and when the target is located, both horizontal and vertical alignment is intended. The frame serves to hold the vertical and horizontal alignment bars, as well as to provide a field of view reference, so that the user can visually acquire the target easier.

As is shown in FIG. 1, the prior art often uses a crosshairs type stadia alignment system, with vertical and horizontal reference bars framing the peep hole. A frame further defines the field of view and holds the vertical and horizontal reference bars.

Figure 2:
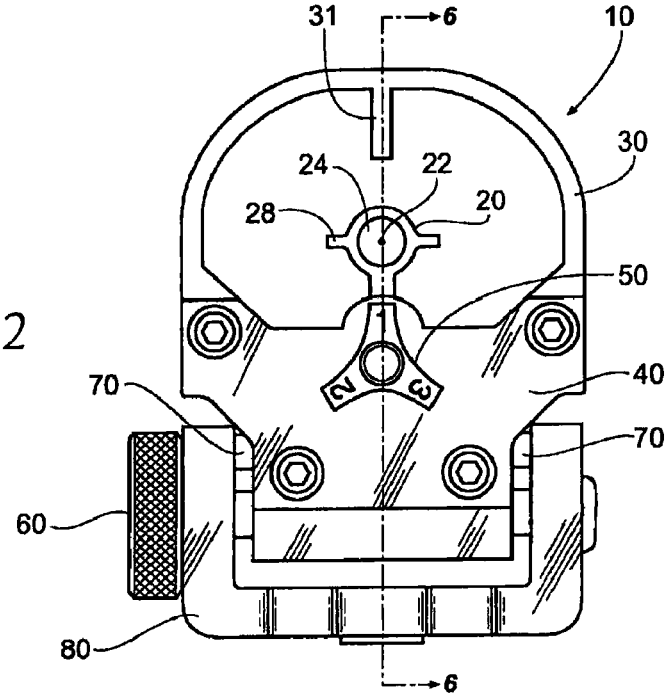
FIG. 2 is a front view of a rotatable and retractable rear gun sight of the present invention.

Referring now to FIG. 2, a front view of a rotatable and retractable rear gun sight 10 of the present invention is shown. A frame 30 carries a rotating gun sight aperture 20, and bar 31, and defines a field of view through the void space or window of the frame. A rotating gun sight aperture 20 with peep hole 24 further defines the field of view on the intended target, along with horizontal reference bar 28 carried by the aperture 20. The front sight 22 is not attached to the rotatable and retractable rear gun sight 10 but is instead carried closer to the gun barrel as shown in the prior art of FIG. 1.

A dial 50 is carried by frame member 40, the dial in operative association to rotate the aperture 20 to one of a predetermined number of, preferably three, aperture members 20*a*, 20*b*, and 20*c* as will be described later.

A windage dial 60 is provided for adjusting the rear gun sight 10 left and right due to wind. Windage refers to the side-to-side adjustment of a rifle's sight, used to change the horizontal component of the aiming point. The up-down adjustment for the vertical component is the elevation.

Spring loading ball detents 70 are provided for retracting the rotatable and retractable rear gun sight 10 into a horizontal position, and vice-versa into the shooting position.

A sight base 80 is providing for holding the rotatable and retractable rear gun sight 10 coupled to the gun, as will be described later.

Figure 3:
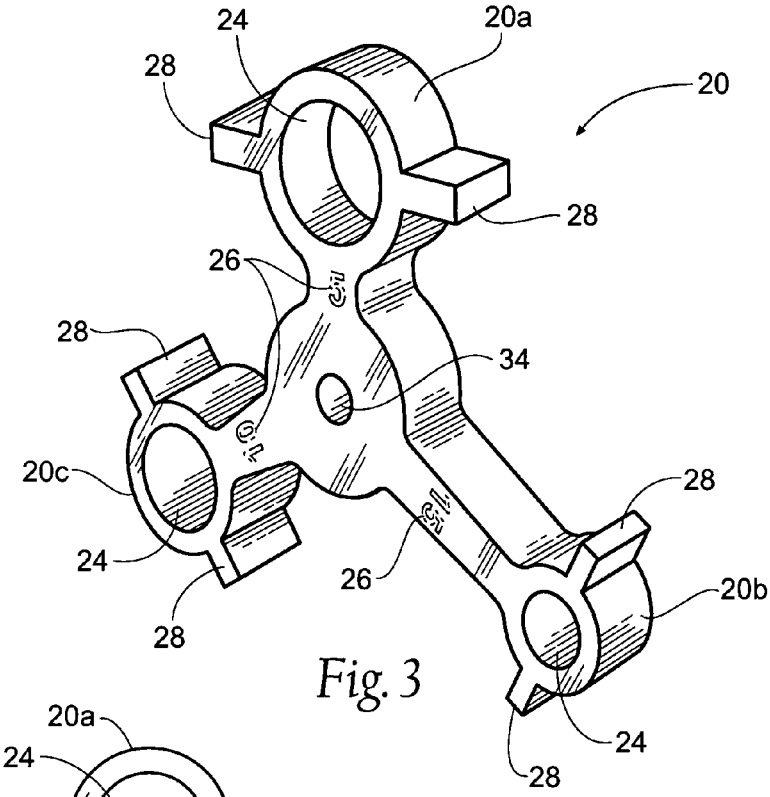
FIG. 3 is a perspective view of a gun sight aperture of the present invention.
Figure 4:
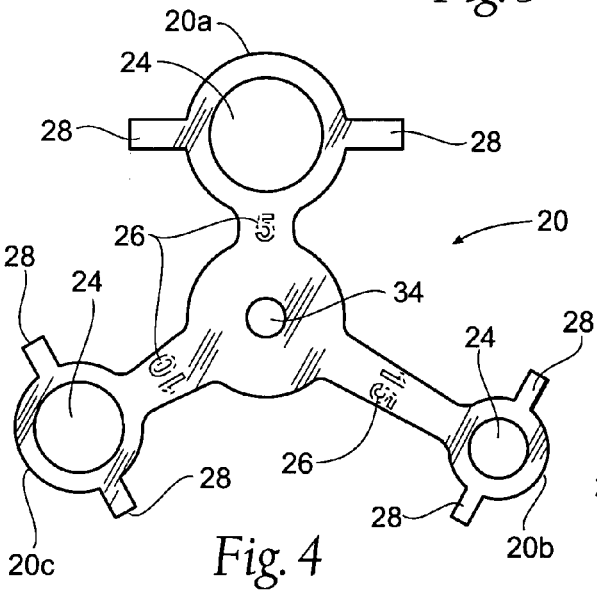
FIG. 4 is a front view of the gun sight aperture of the present invention.
Figure 5:
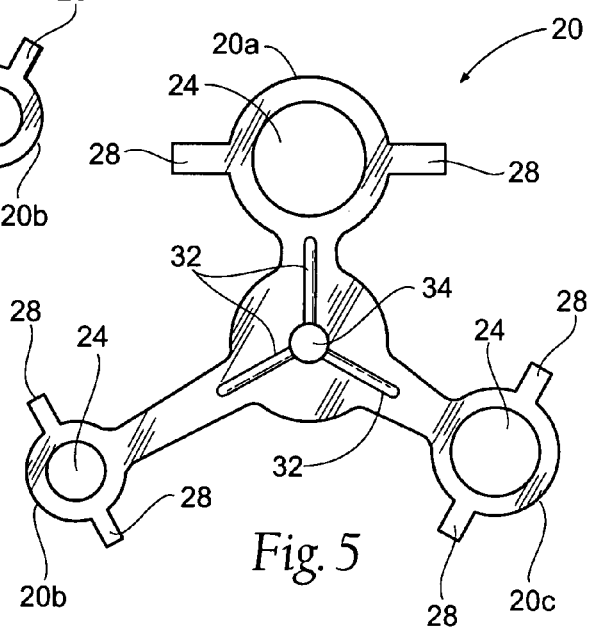
FIG. 5 is a back view of the gun sight aperture of the present invention.

Referring now to FIGS. 3-5, the rotating gun sight aperture 20 of the present invention is shown. As can be seen, a predetermined number of, preferably three, aperture members 20*a*, 20*b*, and 20*c* are provided. In this manner, a user can rotate the rotating gun sight aperture 20 to correspond with three different distances. In the embodiment shown, distance indicia 26 can be provided on the rotating gun sight aperture 20 for ease of reference. Additional sets of apertures 20 can be interchanged with the single set 20 shown, for greater or lesser distances.

It will be appreciated that the shorter the distance from the peep 24 to the center 34 of the rotating gun sight aperture 20, the shorter the target distance represented, as the selected peep 24 of aperture members 20*a*, 20*b*, and 20*c* will be at the 12 o' clock position during shooting.

Figure 6:
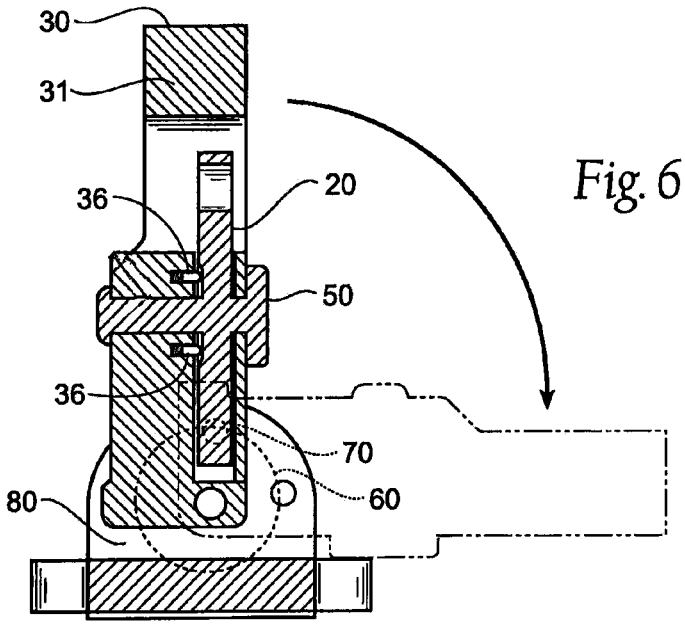
FIG. 6 is a side view, with portions broken away, of the rotatable and retractable rear gun sight of the present invention.

Referring now specifically to FIGS. 5 and 6, a back view of the gun sight aperture 20 of the present invention is shown. Slots 32 are provided for engagement with spring loaded ball detents 36 as will be described with reference to FIG. 6, a side view of the rotatable and retractable rear gun sight 10.

Referring now to FIG. 6, it will be seen that the slots 32 on the rotating gun sight aperture 20 are engaged by spring loaded ball detents 36. When a user engages the dial 50, the user can exert enough pressure on the springs of the spring loaded ball detents 36 to allow rotation of the gun sight aperture 20 through to the selected aperture 20*a*, 20*b*, or 20*c*. Once the appropriate selected channel 32 is engaged by the spring loaded ball detents 36, the spring loaded ball detents 36 click into the channel 32.

Still referring to FIG. 6, the rotatable and retractable rear gun sight 10 similarly can be retracted by tilting downward on frame 30, dislodging ball detents 70 from their associated void spaces on the sight base 80. This engagement is also shown on FIG. 9.

Figure 7:
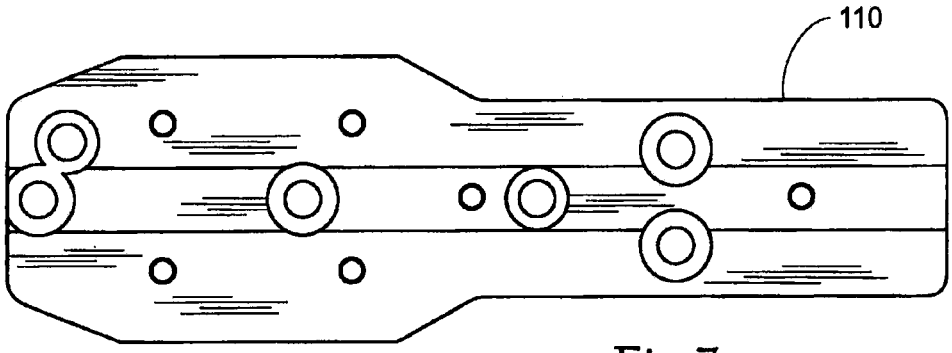
FIG. 7 is a top view of a sight coupling for carrying the rotatable and retractable rear gun sight of the present invention on a gun.

Referring now to FIG. 7, a top view of a sight coupling 110 for carrying the rotatable and retractable rear gun sight 10 is shown. Site base 80 is coupled to the sight coupling 110 (not shown), and sight coupling 110 is in turn coupled to the gun (not shown), such as is shown with reference to the prior art of FIG. 1.

Figure 8:
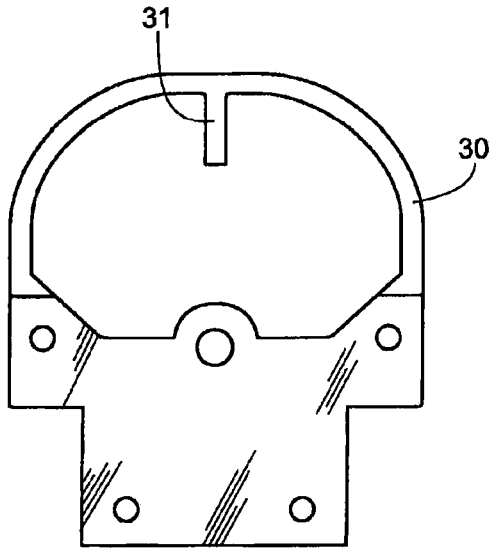
FIG. 8 is a front view of a gun sight frame of the rotatable and retractable rear gun sight of the present invention.

Referring now to FIG. 8, a front view of the gun sight frame 30 is shown.

Figure 9:
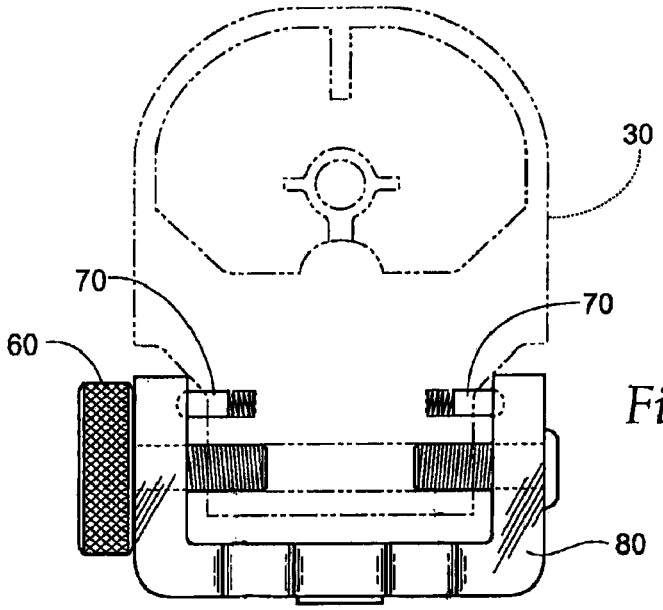
FIG. 9 is a front view of a sight base component of the rotatable and retractable rear gun sight.
Figure 10:
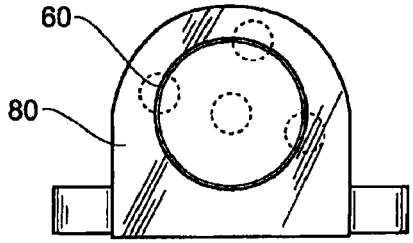
FIG. 10 is a side view of a sight base component of the rotatable and retractable rear gun sight.

Referring now to FIGS. 9-10, front and side views of the sight base 80 of the rotatable and retractable rear gun sight 10 are shown, with portions broken away.

Figure 11:
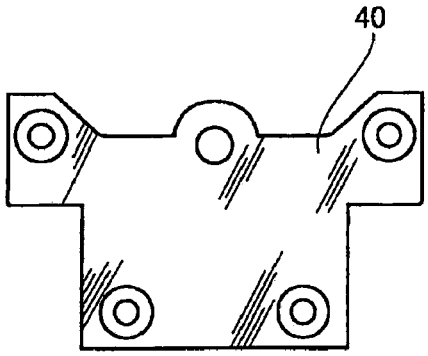
FIG. 11 is a front view of a sight frame member component of the rotatable and retractable rear gun sight.
Figure 12:
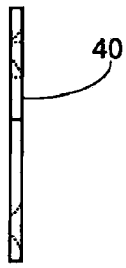
FIG. 12 is a side view of a sight frame member component of the rotatable and retractable rear gun sight.

Referring now to FIGS. 11-12, front and side views of the sight frame member 30 component of the rotatable and retractable rear gun sight 10 are shown. If the user wishes to remove the apertures 20 either for placing different apertures into the sight 10, or for using the apertures 20 on a different gun, the user can remove sight frame member 40 and remove apertures 20.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A rear sight for mounting to a gun, the rear sight comprising:

a frame member configured to be mounted to the gun; and a rotatable sight member supported by the frame member and rotatable with respect to the frame member about an axis of rotation, the rotatable sight member including:

a first sight aperture carried by a first radial arm and having a first sighting center located at a first radial distance from the axis of rotation; and a second sight aperture carried by a second radial arm and having a second sighting center located at a second radial distance from the axis of rotation which is different than the first radial distance, the second sight aperture also being angularly spaced from the first sight aperture relative to the axis of rotation.

2. The rear sight of claim 1 wherein, when the frame member is mounted to the gun, the rotatable sight member is rotatable to select one of the first sight aperture and the second sight aperture as a selected sight aperture for alignment and use in conjunction with a front sight on the gun to target an object at an estimated target distance associated with the selected sight aperture.

3. The rear sight of claim 1, further comprising a sight base to which the frame member is coupled, the sight base being mountable to the gun.

4. The rear sight of claim 3, wherein the frame member is rotatable relative to the sight base about an axis which is generally perpendicular to the axis of rotation of the rotatable sight member between a first, generally vertical shooting position to a second, generally horizontal non-shooting position.

5. The rear sight according to claim 4, the sight base carrying a spring loaded ball detent for retaining said frame member in the first, generally vertical shooting position.

6. The rear sight of claim 3, the sight base carrying a rotatable windage dial for adjusting the rear sight horizontally.

7. The rear sight of claim 1, said frame member further comprising a field of view aperture for framing the first and second apertures.

8. The rear sight of claim 1, said rotatable sight member further comprising a third aperture provided on the rotatable sight member, the third aperture being at a third radial distance from the axis of rotation which is different from the first and second radial distances.

9. The rear sight of claim 1, wherein the rotatable sight member is coupled with a dial for rotating the rotatable sight member.

10. The rear sight of claim 1, wherein each of the first and second apertures are provided with a corresponding radial channel formed in the rotatable sight member, the radial channels cooperating with a spring loaded ball detent carried by the frame member to selectively align one of the first and second apertures with a front sight of the gun.

11. The rear sight of claim 1, wherein the rotatable sight member further comprises a reference bar for horizontal shot reference.

12. The rear sight of claim 1, wherein the frame member further includes a reference bar for vertical shot reference.

* * * * *